8/13/85 OR 4,535,266 SR

United States Patent [19]
Say

[11] Patent Number: 4,535,266
[45] Date of Patent: Aug. 13, 1985

[54] IN-LINE ELECTRON GUN STRUCTURE FOR COLOR CATHODE RAY TUBE HAVING TAPERED WALLS AND ELONGATED APERTURES FOR BEAM SPOT-SHAPING

[75] Inventor: Donald L. Say, Waterloo, N.Y.

[73] Assignee: North American Philips Consumer Electronics Corp., New York, N.Y.

[21] Appl. No.: 490,639

[22] Filed: May 2, 1983

[51] Int. Cl.³ ..... H01J 26/62
[52] U.S. Cl. ..... 313/414
[58] Field of Search ..... 313/414, 412, 413

[56] References Cited

FOREIGN PATENT DOCUMENTS

| | | | |
|---|---|---|---|
| 120581 | 9/1979 | Japan | 313/414 |
| 134971 | 10/1979 | Japan | 313/414 |
| 82548 | 7/1981 | Japan | 313/413 |
| 44655 | 3/1983 | Japan | 313/414 |

*Primary Examiner*—Palmer Demeo
*Attorney, Agent, or Firm*—Thomas A. Briody; Jack Oisher; John C. Fox

[57] ABSTRACT

In-line electron gun structure for color cathode ray tubes in which the final focusing and accelerating electrodes each employ three in-line tapered, partially overlapping apertures in facing relationship, and at least one aperture opening, preferably the central aperture of the focusing electrode, is elongated to provide electron beam spot-shaping.

9 Claims, 10 Drawing Figures

IN-LINE ELECTRON GUN STRUCTURE FOR COLOR CATHODE RAY TUBE HAVING TAPERED WALLS AND ELONGATED APERTURES FOR BEAM SPOT-SHAPING

CROSS REFERENCE TO RELATED APPLICATIONS

U.S. patent application Ser. No. 463,791, filed Feb. 4, 1983, describes and claims color cathode ray tube electrodes having tapered apertures. Such application is a continuation-in-part of Ser. No. 450,574, filed Dec. 16, 1982, now abandoned.

U.S. patent application Ser. No. 484,780, filed Apr. 14, 1983, describes and claims color cathode ray tube electrodes having tapered apertures and beam spot shaping inserts.

The above applications are assigned to the assignee of the present invention.

BACKGROUND OF THE INVENTION

This invention relates to an in-line electron gun structure for color cathode ray tubes (CCRT), in which the apertures of the final focusing and accelerating electrodes are tapered, and more particularly relates to such structures in which one or more apertures are elongated for electron beam spot-shaping.

Reducing the diameter of the necks of CCRTs can lead to cost savings for the television set maker and user in enabling smaller beam deflection yokes and consequent smaller power requirements. However, reducing neck diameter while maintaining or even increasing beam deflection angle and display screen area severely taxes the performance limits of the electron gun.

In the conventional, in-line electron gun design, an electron optical system is formed by applying critically determined voltages to each of a series of spatially positioned apertured electrodes. Each electrode has at least one planar apertured surface oriented normal to the tube's long or Z axis, and containing three side-by-side or "in-line" circular straight-through apertures. The apertures of adjacent electrodes are aligned to allow passage of the three (red, blue, and green) electron beams through the gun.

As the gun is made smaller to fit in the so-called "mini-neck" tube, the apertures are also made smaller and the focusing or lensing aberrations of the apertures are increased, thus degrading the quality of the resultant picture on the display screen.

Various design approaches have been taken to attempt to increase the effective apertures of the gun electrodes. For example, U.S. Pat. No. 4,275,332, and U.S. patent application Ser. No. 303,751, filed Sept. 21, 1981 and assigned to the present assignee, describe overlapping lens structures. U.S. patent application Ser. No. 463,791, filed Feb. 4, 1983 and assigned to the present assignee, describes a "conical field focus" or CFF lens arrangement. Each of these designs is intended to increase effective apertures in the main lensing electrodes and thus to maintain or even improve gun performance in the new "mini-neck" tubes.

In the CFF arrangement, the electrode apertures have the shapes of truncated cones or hemispheres, and thus each aperture has a small opening and a related larger opening. In a preferred embodiment, the apertures are positioned so that the larger openings overlap. This overlapping eliminates portions of the sidewalls between adjacent apertures, leaving an arcuate "saddle" between these apertures.

Regardless of their complex shapes, CFF electrodes may be produced by deep drawing techniques, offering a marked cost advantage over other complex designs. However, in forming the CFF electrodes by drawing for mass production quantities, it has been discovered that the edge of the saddle between adjacent apertures becomes rounded, resulting in a slight decrease in the wall area between the apertures. Unfortunately, such a slight modification to the electrode is sufficient to distort the lensing field, and result in an out-of-round spot for the central electron beam on the display screen.

It is an object of the present invention to provide a modified electron gun structure with overlapping tapered apertures, which modified structure will compensate for the distortion in the lensing field caused by rounded saddles.

SUMMARY OF THE INVENTION

In accordance with the invention, a lensing arrangement, featuring partially overlapping tapered apertures with generally circular openings in the final focusing and accelerating electrodes of an in-line electron gun for a CCRT, is modified by elongating at least one of the openings to provide electron beam spot-shaping, and to compensate for the distortion in the lensing field caused by rounded saddles between adjacent apertures.

Such arrangement involves the final low voltage (focusing) and high voltage (accelerating) lensing electrodes. The forward portion of the focusing electrode and the rear portion of the accelerating electrode are in adjacent, facing relationship, and each defines three partially overlapping, tapered, in-line apertures, a central aperture and two side apertures. The apertures are of a three-dimensional surface of revolution (hereinafter called a volumetric configuration), which is substantially truncated, for example, a truncated cone or hemisphere, the axes of symmetry of which are parallel to one another and to the associated path of the electron beam. Each aperture has a large opening in an outer aperture plane of the electrode and a smaller opening in the interior of the electrode, the openings being generally circular and being separated by sloping sidewalls. A portion of the sidewall of each aperture intersects a portion of the sidewall of an adjacent aperture to form an inwardly-sloping arcuate rounded saddle along the region of the intersection. The resulting structure is derived from the partial overlapping of geometric constructions of the volumetric configurations.

In order to compensate for the lensing field distortion caused by the rounded saddles, the structure includes at least one elongated, electron beam spot-shaping opening, preferably the smaller-dimensioned opening of the central aperture of at least one of the lensing electrodes.

As used herein, the term "elongated" generally means the form resulting from expansion of a circle along a radium (oblong), but also includes forms resulting from such expansion accompanied by some distortion of the circular curvature (eg., ellipse).

In the presently most preferred embodiment, the smaller dimensioned beam-entering rear opening of the central aperture of the focusing electrode is elongated in a direction normal to the in-line plane of the electron gun.

Alternatively, the smaller-dimensioned beam-exiting front opening of the central aperture of the accelerating electrode is elongated in the direction of the in-line plane of the electron gun.

As a further alternative, the larger-dimensioned central aperture opening of either the focusing or accelerating electrode may be elongated to achieve beam spot-shaping.

DESCRIPTION OF THE PREFERRED EMBODIMENTS

Figure 1:
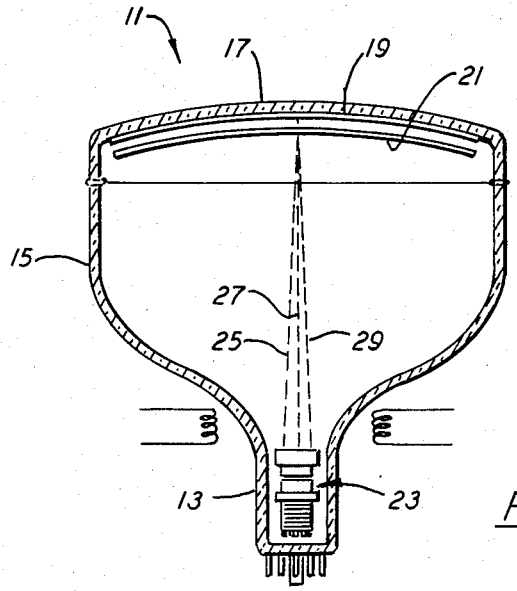
FIG. 1 is a sectioned elevation view of a color cathode ray tube wherein the invention is employed.

With reference to FIG. 1 of the drawings, there is shown a color cathode ray tube (CCRT) 11 of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel, spaced from the patterned screen.

Encompassed within the envelope neck portion 13 is a unitized plural beam in-line electron gun assembly 23, comprised of a unitized structure of three side-by-side guns. Emanating therefrom are three separate electron beams 25, 27, and 29 which are directed to pass through mask 21 and land upon screen 19. It is within this electron gun assembly 23 that the structure of the invention resides.

Figure 2:
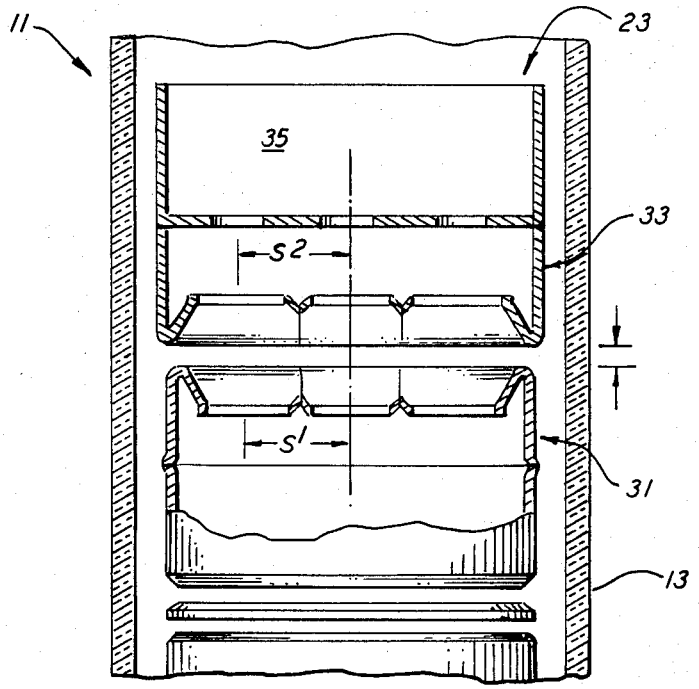
FIG. 2 is a sectioned view of the forward portion of the in-line plural beam electron gun assembly shown in FIG. 1, such view being taken along the in-line plane thereof.

Referring now to FIG. 2, the forward portion of the electron gun 23 of FIG. 1 is shown, including a low potential electrode 31, a high potential electrode 33, and a convergence cup 35. Electrode 31 is the final focusing electrode of the gun structure, and electrode 33 is the final accelerating electrode.

In a "Uni-Bi" gun typically used in mini-neck CCRTs, the main focusing electrode potential is typically 25 to 35 percent of the final accelerating electrode potential, the inter-electrode spacing is typically about 0.040 inches (1.02 millimeters), the angle of taper of the apertures is about 30° with respect to the tube axis, and the aperture diameters (smaller and larger dimensioned openings) are 0.140 and 0.220 inches (3.56 and 5.59 millimeters) for the focusing electrode and 0.150 and 0.250 inches (3.81 and 6.35 millimeters) for the accelerating electrode. The spacing between aperture centers is 0.177 inch (4.50 millimeter) ($S^1$) for the focusing electrode and 0.182 inch (4.62 millimeter) ($S^2$) for the accelerating electrode.

Together, these two electrodes form the final lensing fields for the electron beams. This is accomplished by cooperation between their adjacent, facing apertured portions to form lensing regions which extend across the inter-electrode space. The tapered sidewalls of the apertures enable optimum utilization of the available space inside the tube neck 13.

Figure 3:
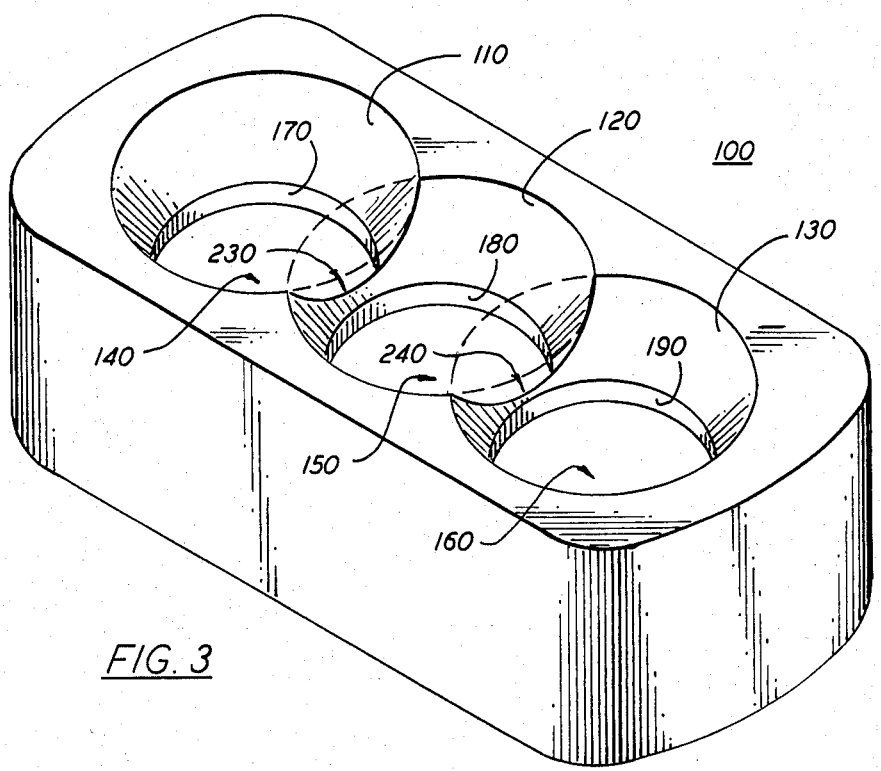
FIG. 3 is a perspective view from above of the unitized low potential lensing electrode of the gun assembly of FIG. 2, affording a partial view of the small openings of the apertures.
Figure 8:
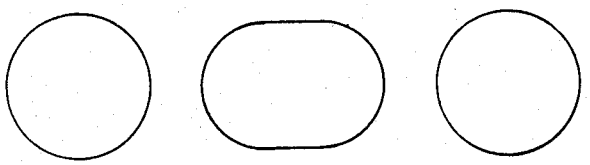
FIG. 8 is a representation of beam spot shapes related to the electron gun of FIG. 2 without spot-shaping openings.
Figure 4:
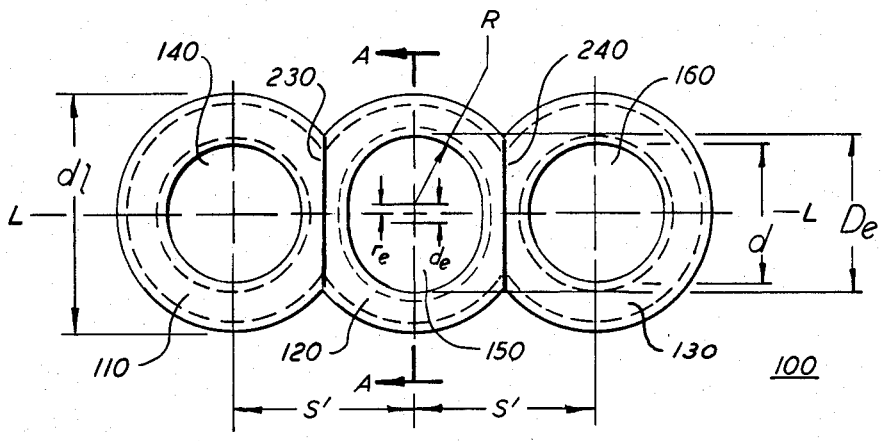
FIG. 4 is a top view of one embodiment of the apertures of the unitized low potential lensing electrode of the invention including an elongated rear opening of the central aperture.

Referring now to FIG. 3, there is shown a focusing electrode 100 of the type shown in FIG. 2, having three in-line apertures with large front beam-exiting openings 110, 120 and 130 substantially in the forward planar surface of the electrode, and smaller rear beam-entering openings 140, 150 and 160 in the interior of the electrode, such openings connected by substantially tapered sidewalls terminating with relatively short cylindrical portions 170, 180 and 190. Geometric constructions of the apertures are truncated cones (ignoring cylindrical portions 170, 180 and 190) which partially overlap one another. This overlap is indicated in phantom in the forward planar surface, and results in the partial removal of sidewall portions of adjacent aperture and the formation of inwardly sloping arcuate edges 230 and 240. In fabrication of such electrode structure by drawing, the edge tends to have a rounded contour forming what is termed herein a "saddle", resulting in reduced sidewall area between apertures and distortion of the lensing field. This field distortion results (for a typical Uni-Bi mini-neck gun as described above) in electron beam spots at the screen as shown in FIG. 8. That is, the central beam spot tends to become compressed vertically and elongated in the direction of the in-line plane of the three beams. Compensation for such distortion is provided herein by beam spot-shaping elongation of the apertures, one embodiment of which is shown in FIG. 4, which is a top view of the aperture portion of focusing electrode 100. Side aperture openings 140 and 160 are circular, having a diameter "d", while central aperture opening 150 is elongated along each radius normal to in-line plane L by an amount $r_e$, for a total elongation of two times $r_e$, or $d_e$. Thus, the elongated dimension $D_e$ of central opening 150 is d plus $d_e$. The amount of elongation will vary depending upon the degree of field distortion present and the amount of compensation desired, the amount of compensation increasing with the amount of elongation.

For the Uni-Bi gun described above, the amount of elongation may vary from about 10 to 35 percent ($d_e/d \times 100$) in the focusing electrode, and from about 15 to 40 percent in the accelerating electrode. A greater degree of elongation in the accelerating electrode is generally required to achieve the desired compensation because the electrons are traveling faster through this electrode than through the focusing electrode, and are less influenced by field distortions.

Figure 5:
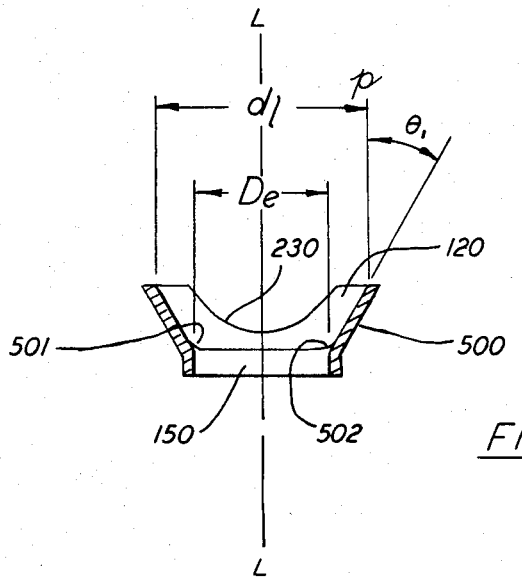
FIG. 5 is a sectioned elevation view of the embodiment of the low potential electrode of FIG. 4 taken along the plane A—A in FIG. 4.

Referring now to FIG. 5, which is a section view along plane A—A of FIG. 4, it is seen that front aperture 120 and rear aperture 150 are connected by tapered sidewall 500, which forms an angle $\theta_1$ with line p, parallel to the tube axis. The elongation of opening 150 results in a slight increase in the height of the elongated cylindrical portion of the aperture, indicated at 501 and 502. The diameters of the front apertures 110, 120 and 130 all have the diameter $d_e$.

Figure 6:
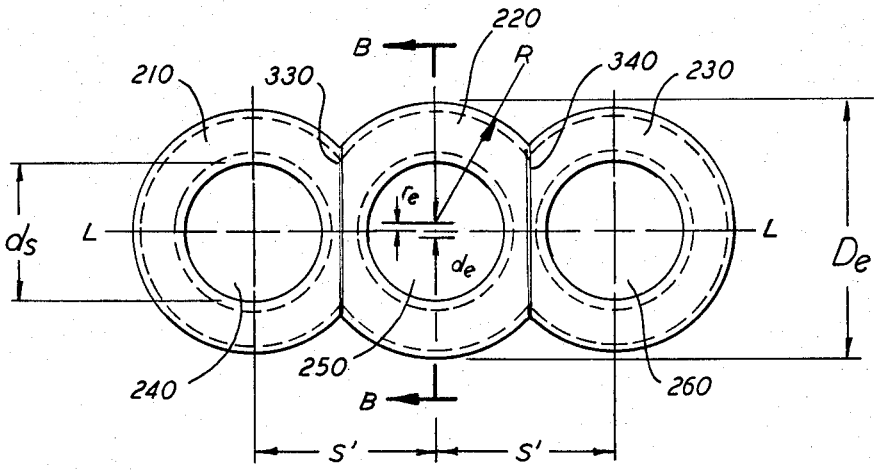
FIG. 6 is a top view of another embodiment of the apertures of the low potential electrode of the invention, including an elongated front opening of the central aperture.

Another embodiment of the beam spot-shaping structure for the central aperture of the focusing electrode is shown in FIG. 6. In this embodiment, the large opening 220 of the central aperture is elongated, rather than the small opening 250. Elongation is again by an amount of two times $r_e$ or $d_e$, resulting in an elongated dimension $D_e$. For a given amount of compensation, the amount of elongation required in the large opening is generally less than in the small opening. This is true for both the focusing and accelerating electrodes. The reason for this is that the large openings are closer to the concentration gradient of the lensing fields, and thus less control is required to achieve the desired compensation. Nevertheless, elongation of the smaller openings is generally preferred because of the greater space available in the interior of the electrode than in the forward or apertured plane of the electrode.

For the Uni-Bi gun described above, the amount of elongation may vary from about 3 to 15 percent for the focusing electrode, and from about 5 to 20 percent for the accelerating electrode. In the embodiment of FIG. 6, the rear apertures 240, 250 and 260 all have the diameter $d_s$.

Figure 7:
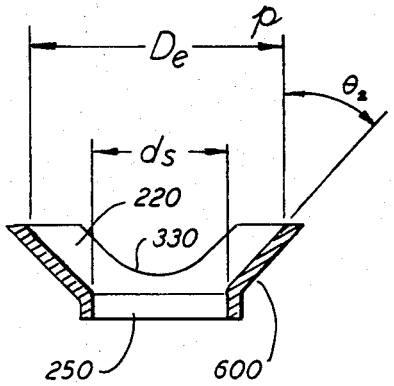
FIG. 7 is a sectioned elevation view of the embodiment of FIG. 6 taken along the plane B—B of FIG. 6.

In FIG. 7, a section view along plane B—B of FIG. 6, front aperture 220 and rear aperture 250 are connected by tapered sidewall 600, which forms angle $\theta_2$ with line p, parallel to the tube axis L.

Figure 9:
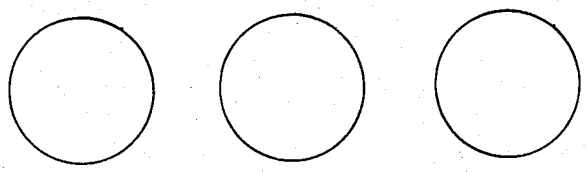
FIG. 9 is a representation of beam spot shapes related to the electron gun of FIG. 2 with spot-shaping openings.

FIG. 9 shows the beam spots after compensation by use of the elongated aperture openings as described herein.

Figure 10:
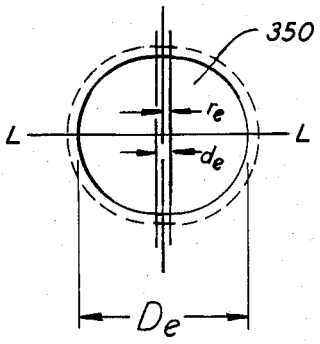
FIG. 10 is a top view of an elongated front opening of the central aperture of a unitized high potential lensing electrode of the invention.

FIG. 10 shows the smaller opening 350 of the central aperture of the accelerating electrode, which opening 350 is elongated by an amount $d_e$ to obtain dimension $D_e$. The principles of electron optics dictate that the direction of elongation in the accelerating electrode must be the same as the direction of elongation of the distorted beam spot, whereas the direction of elongation in the focusing electrode must be normal thereto, to achieve beam spot correction.

While there have been shown and described what are at present considered to be the preferred embodiments of the invention, it will be obvious to those skilled in the art that various changes and modifications may be made therein without departing from the scope of the invention as defined by the appended claims. Just as one example, the side aperture openings can also be elongated in the same manner described for the central openings, to influence the shaping of the side aperture-related beam spots. This may be necessary, for example, in gun structures other than the particular Uni-Bi structure described herein.

What is claimed is:

1. In an in-line electron gun structure for a color cathode ray tube, a lensing arrangement in the final focusing and accelerating electrodes comprising:

a first lensing structure in the forward portion of the focusing electrode, such structure having three in-line tapered apertures of substantially truncated volumetric configuration having substantially parallel axes of symmetry, each aperture having front beam exits and smaller dimensioned rear beam entrances, the front exits and rear entrances being generally circular and separated by sloping sidewalls, a portion of the sidewall of each aperture intersecting with a portion of the sidewall of an adjacent aperture to form an inwardly sloping arcuate rounded saddle along the region of intersection, such structure resulting from the partial overlapping of geometric constructions of the volumetric configurations; and a second lensing structure in the rear portion of the final accelerating electrode in adjacent, facing relationship with the first structure, such second structure having three in-line tapered apertures of substantially truncated volumetric configuration having substantially parallel axes of symmetry, each aperture having rear beam entrances and smaller dimensioned front beam exits, the front exits and rear entrances being generally circular and separated by sloping sidwalls, a portion of the sidewall of each aperture intersecting with a portion of the sidewall of an adjacent aperture to form an inwardly sloping arcuate rounded saddle along the region of intersection, such structure resulting from the partial overlapping of geometric constructions of the volumetric configurations, at least one of said entrances and exits in said first and second lensing structures being elongated to provide electron beam spot-shaping, elongation in the first structure being normal to the in-line plane and elongation in the second structure being in the direction of the in-line plane.

2. The electron gun structure of claim 1 wherein the rear opening of the central aperture of the first lensing structure is elongated in a direction normal to the in-line plane.

3. The electron gun structure of claim 2 wherein the opening is elongated by an amount of from about 10 to 35 percent of the diameter of the opening in the in-line plane.

4. The electron gun structure of claim 1 wherein the front opening of the central aperture of the second lensing structure is elongated in the direction of the in-line plane.

5. The electron gun structure of claim 4 wherein the opening is elongated by an amount of from about 15 to 40 percent of the diameter of the opening normal to the in-line plane.

6. The electron gun structure of claim 1 wherein the front opening of the central aperture of the first lensing structure is elongated in a direction normal to the in-line plane.

7. The electron gun structure of claim 6 wherein the opening is elongated by an amount of from about 3 to 15 percent of the diameter of the opening in the in-line plane.

8. The electron gun structure of claim 1 wherein the rear opening of the central aperture of the second lensing structure is elongated in the direction of the in-line plane.

9. The electron gun structure of claim 8 wherein the opening is elongated by an amount of from about 5 to 20 percent of the diameter of the opening normal to the in-line plane.

* * * * *